US005180289A

United States Patent [19]

Wenholz et al.

[11] Patent Number: 5,180,289

[45] Date of Patent: Jan. 19, 1993

[54] AIR BALANCE CONTROL FOR A PUMPING UNIT

[75] Inventors: Bruce Wenholz, Glendale, Calif.; R. H. Gault, Lubbock, Tex.; Kerry A. Jones, Bakersfield, Calif.

[73] Assignee: Baker Hughes Incorporated, Houston, Tex.

[21] Appl. No.: 750,280

[22] Filed: Aug. 27, 1991

[51] Int. Cl.[5] ..... F04B 47/14

[52] U.S. Cl. ..... 417/53; 60/372

[58] Field of Search ..... 60/372, 371, 369, 415; 100/259; 417/390, 18, 22, 63, 53

[56] References Cited

U.S. PATENT DOCUMENTS

| | | | |
|---|---|---|---|
| 2,808,735 | 10/1957 | Becker | 60/372 X |
| 3,115,806 | 12/1963 | Stimmell | 60/372 X |
| 4,490,094 | 12/1984 | Gibbs | 417/53 X |
| 4,583,915 | 4/1986 | Montgomery et al. | 417/63 X |

OTHER PUBLICATIONS

Preliminary Release Notice entitled Air Balanced Pumping Unit Controller (Air Balance Controller) Model ABC-100 (undated).

Excerpt from "What's new in artificial lift," World Oil, May 1989 p. 32 entitled Automatic Counterbalancing for Air Balanced Units, by Lea, J. F. and Winkler, H. W.

Brochure entitled Baker Model 8650 Rod Pump Controller (undated).

Excerpt from Baker CAC Model 8650 Rod Pump Controller, Installation & Operation Manual, dated Jun. 7, 1991.

*Primary Examiner*—Leonard E. Smith

*Attorney, Agent, or Firm*—Rosenblatt & Associates

[57] ABSTRACT

An air-balance control system for a pumping unit minimizes the difference in torque on pumping unit components on the upstroke and the downstroke. The control system measures pump motor current and rod string position to effectuate porting air to or venting air from the air receiver tank in an air-balance system.

8 Claims, 4 Drawing Sheets

| AREA OF FIGURE 1 | PREVIOUS ACTION | | |
|---|---|---|---|
| | SAT | NC | SRT |
| 1 | SAT | SAT | NC |
| 2 | SAT | NC | NC |
| 3 | NC | NC | NC |
| 4 | NC | NC | NC |
| 5 | NC | NC | NC |

| AREA OF FIGURE 1 | PREVIOUS ACTION | | |
|---|---|---|---|
| | SAT | NC | SRT |
| 1 | NC | NC | NC |
| 2 | NC | NC | NC |
| 3 | NC | NC | NC |
| 4 | NC | NC | SRT |
| 5 | NC | SRT | SRT |

AIR BALANCE CONTROL FOR A PUMPING UNIT

FIELD OF THE INVENTION

The present invention relates generally to oil field pumping units and more particularly, to a method and a control device to equalize the torque on an oil field pump on the upstroke and the downstroke.

BACKGROUND OF THE INVENTION

Pumping oil from geological structures requires a pumping unit. The pumping unit oscillates a sucker rod string in an essentially vertical direction in repetitive upstrokes and downstrokes. The unit is driven by a relatively high-speed motor driving reduction gears which develop the reciprocating action. However, the resistance to the pumping presented by the down-hole pump, the weight of the sucker rod string, and the weight of the oil is quite different on the upstroke than the resistance presented on the downstroke. Since the pumping unit overcomes this resistance through the development of torque, the differences in resistances develop differences in torque on the upstroke and downstroke.

The differences in upstroke and downstoke torque cause imbalances in the pumping unit mechanism and result in excessive wear and tear on the various components of the unit and premature failure of the unit. These imbalances also waste precious energy in overcoming the unequal resistances. Ideally, the unit would develop the same torque on the upstroke as on the downstroke.

Known systems have tried to overcome the imbalance problem in primarily two ways. Some systems use counterbalance weights to try to equalize the imbalance in upstroke and downstroke. These systems are static in that they make no account of changes in upstroke and downstroke torque; they achieve an ideal balance at only a single relative difference in upstroke and downstroke torque. Further, these systems are highly inefficient in that the driving motor and mechanism must maintain the rotary motion of the heavy counterbalance. These systems do, however, provide an advantage in that they are very simple.

The other major type of system that tries to overcome the imbalance problem is the air-balance system. These systems provide a pneumatic cushion that differs on the upstroke and downstroke so that the torque in the two directions is more nearly equal. Early air-balance systems used a Murphy switch to maintain a minimum amount of pressure in the system. If air pressure within the system got too low and reached the lower trip setpoint, compressed air from an air compressor or air receiver was pumped into the system until system pressure reached the upper trip setpoint of the Murphy switch at which point the air pumping was stopped.

Such a system suffered from the drawback that it made no account for effects on the various components of the pumping unit. It simply maintained pressure within the set band, regardless of effects on the motor driving the pumping unit, for example.

Other known systems attacked this drawback by providing a means for monitoring system motor rpm. Such a system is made by Nabla of Midland, Tex. and is described in "World Oil, " May, 1989. This system retained the Murphy switch but set the low and high pressure settings further apart as a backup should the monitor fail to activate or stop the compressor. The monitor of this system converts rpm data to motor output torque from motor torque/speed performance data. Such a system suffers a drawback in that it derives motor torque empirically, making no account for motors that vary from the performance data, either from motor to motor, or as a result of aging in the motor.

Thus, there remains a need for an air-balance control system for a pumping unit that measures parameters of an operating pump unit directly and utilizes those measured parameters to dynamically balance the operation of the system. Such a system should operate on actual operating conditions and not rely on performance data.

SUMMARY OF THE INVENTION

The present invention solves the problems of the prior art by sensing current drawn by the pumping unit's motor and the position of the rod string continuously. The current sensor is simpler, less expensive, and more rugged than prior art devices. Importantly, the current sensor measures a system operating parameter which is directly related to the torque on the system drive components. The current sensor develops a signal indicative of motor current and the position sensor develops a signal indicative of the sucker rod string position.

A controller uses the current signal and the position signal to determine when and if one of a pair of timers is to be started. The length of time that it takes an activated timer to time out is a user defined time set into the controller. The controller also determines and compares the peak currents on the upstroke and the downstroke of the pumping unit and, based on this comparison, the position of the sucker rod string, and the immediately preceding action of the controller, determines if an add air timer or a release air timer is to be actuated, thus adding or releasing air from the air balance compensation system.

These and other features of the present invention will be immediately apparent to those of skill in the art when viewing the following drawing figures and reviewing the following detailed description.

DETAILED DESCRIPTION OF A PREFERRED EMBODIMENT

Figure 1:
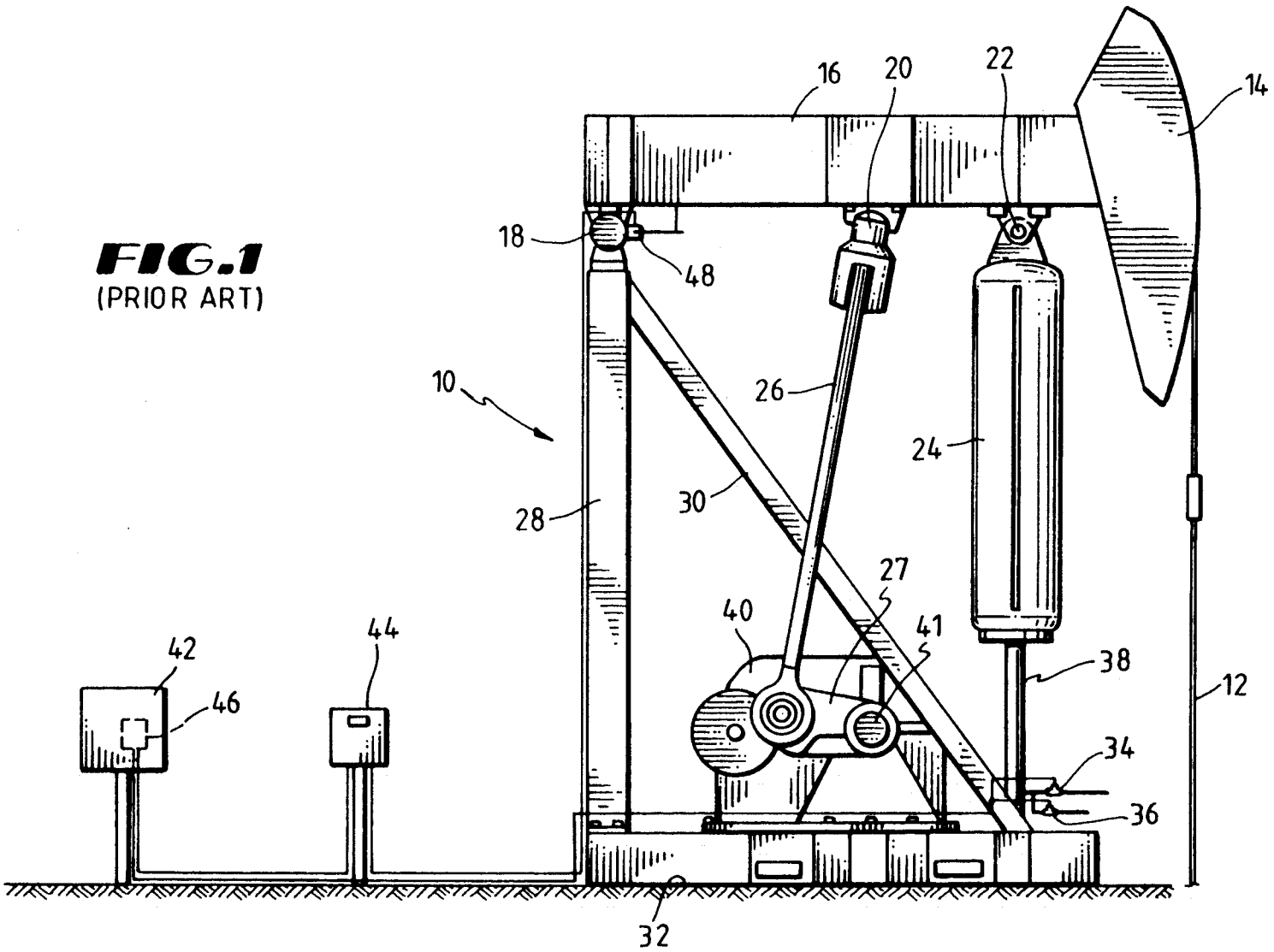
FIG. 1 (PRIOR ART)
FIG. 1 depicts a side view of a pumping unit that includes an air-balance control system.

FIG. 1 depicts a pumping unit 10 that may employ the present invention. The unit 10 includes a sucker-rod string 12 that is attached to and moved up and down by a horse's head 14. The horse's head 14 is mounted to the end of a walking beam 16. The walking beam 16 supports three pivot members 18, 20, and 22. The pivot member 22 connects the walking beam 16 to an air receiver tank 24. The pivot member 20 connects the walking beam 16 to a connecting rod 26 and to a crank arm 27. The pivot member 18 connects the walking beam 16 to a Sampson post 28.

The pumping unit further includes a structural member 30 to further provide structural rigidity to the assembly. The structural member 30 connects the Sampson post 28 with a foundation 32 for mechanical support of all of the moving elements of the unit. This arrangement is shown for purposes of illustration of the overall environment in which the present invention may be used and those of skill in the art will recognize that many other arrangements are of course possible.

Figure 2:
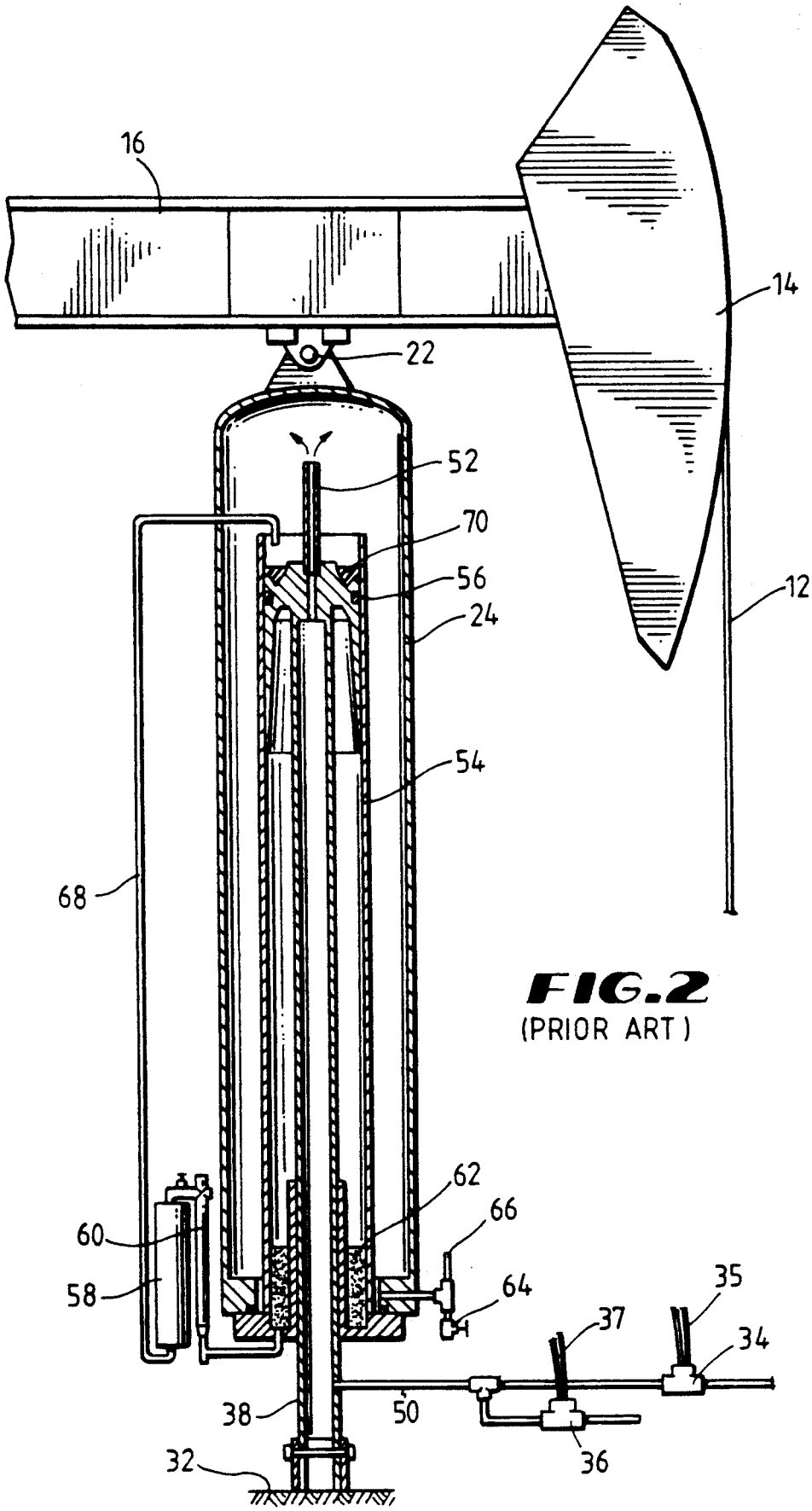
FIG. 2 (PRIOR ART)
FIG. 2 depicts a cutaway view of the air-balance control system including add and release air solenoid valves that are used in the present invention.

The air receiver tank 24 is joined to the walking beam 16 by a pivot member 22. Thus, as the walking beam 16 and the horse's head 14 move up and down, the air receiver 24 moves up and down with them. The air receiver tank 24 has disposed therein a piston, shown in greater detail in FIG. 2. The air pressure within the air receiver tank 24 is maintained by a set of cylinder air pressure control valves 34 and 36. The cylinder air pressure control valve 34 may be the add air solenoid valve and the cylinder air pressure control valve 36 may be the release air solenoid valve, as shown in FIG. 2. While the control valves 34 and 36 have been described as solenoid valves, any electrically operated valves that can control the flow of pressurized air will work satisfactorily and within the scope and spirit of the present invention. The cylinder air pressure control valves 34 and 36 control the air pressure to a tube 38 which provides air to the air receiver tank 24. The tube 38 is pivotally mounted to the foundation 32, as shown in FIG. 2.

The pumping unit further includes a motor and reduction gear assembly 40. The motor and reduction gear assembly 40 drives the crank arm 27 and the connecting rod 26 in the familiar combined rotating and oscillating motion to drive to the horse's head 14 and consequently the sucker rod string 12 in the vertical direction.

The unit also includes a motor control panel 42 and a rod pump controller 44. The motor control panel receives main power from the power pole (not shown) and contains all of the main power switches and contactors. The motor control panel 42 is controlled by a Hand/Off/Automatic (HOA) control switch (not shown). If the HOA control switch is in the Hand position, the rod pump controller 44 is bypassed and control of the rod pump is at the motor control panel. If the HOA switch is in the Off position, the rod pump is deenergized and the rod pump will not run. However, if the HOA switch is in the Automatic position, the rod pump is controlled by the rod pump controller based on a number of criteria, one of which is the subject of the present invention. Thus, the rod pump controller interfaces the motor control panel 42 and the motor and reduction gear assembly 40 of the pumping unit 10.

The motor control panel also includes a current measuring sensor 46. The current measuring sensor 46 senses the current being drawn by the rod pump motor of the motor and gear assembly 40. The current measuring sensor 46 provides one of the two input signals used by the air-balance control of the present invention. A position measuring sensor 48 provides the other input signal. The position measuring sensor measures the position of the sucker rod string 12 to tell the system where the pumping unit is in its stroke.

FIG. 2 provides a section view of the air receiving tank 24 and its associated structure. The system of FIG. 2 may be referred to as an air-balance compensation system. The present invention controls the air pressure within the known air-balance compensation system. The air receiving tank and associated structure are of conventional design and are available from a variety of manufacturers, including Lufkin Industries, Inc., Lufkin, Tex.

The air receiving tank 24 is pivotally joined to the walking beam 16 by a pivoting member 22. FIG. 2 depicts the walking beam 16, the horse's head 14, and the sucker rod string at the very bottom of their stroke. At this point, the air pressure within the air receiving tank is greatest.

Air is ported to the air receiving tank 24 by an add air solenoid valve 34, one of the cylinder air pressure control valves. Air is vented from the air receiving tank by a release air solenoid valve 36. The valves 34 and 36 are mechanically coupled to the air receiving tank by an air conduit 50. The valves 34 and 36 are electrically coupled to the rod pump controller via a set of wires 35 and 37. The air conduit 50 connects to the tube 38 and the tube provides air pressure to the air receiving tank via a vent 52. The vent 52 will also carry air from the air receiving tank into the tube 38 and out the release air solenoid valve 36.

The major components of the structure associated with the air receiving tank are: an air cylinder 54, a set of piston rings 56, a cylinder lubricator 58, and an oil level gauge 60. The structure also includes an oil reservoir 62, an overflow oil drain 64, a relief valve 66, an oil line 68, and an oil annulus 70.

As the walking beam rises on a pumping stroke, the air receiving tank rises with its associated structure except for the tube 38, which is pivotally mounted to the foundation 32. The air pressure drops continuously while the air receiving tank is drawn upward, reaching its minimum value at the top of the stroke. The air pressure within the air receiving tank is maintained to equalize the force required on the upstroke and the downstroke and thus equalize the torque on the mechanism that drives the rod pump. Proper pumping unit operation is achieved when the amount of energy used by the pumping unit's electric motor is the same on the upstroke as on the downstroke. The energy used by the electric motor is directly related to the amount of electric current (amperage) drawn by the motor. By monitoring the electric motor's current usage during the stroke cycle and the position of the sucker rod string during the stroke cycle it can be determined if the pumping unit is properly counter balanced.

The current measuring sensor 46 is used to measure the current to the motor and the position measuring sensor 48 is used to determine the position of the sucker rod string. The parameters of interest that are measured by the current measuring sensor 46 are the peak currents on the upstroke and the downstroke. Signals from these sensors are sent to the rod pump controller 44 which correlates the motor current to the position of the rod string.

Figure 3:
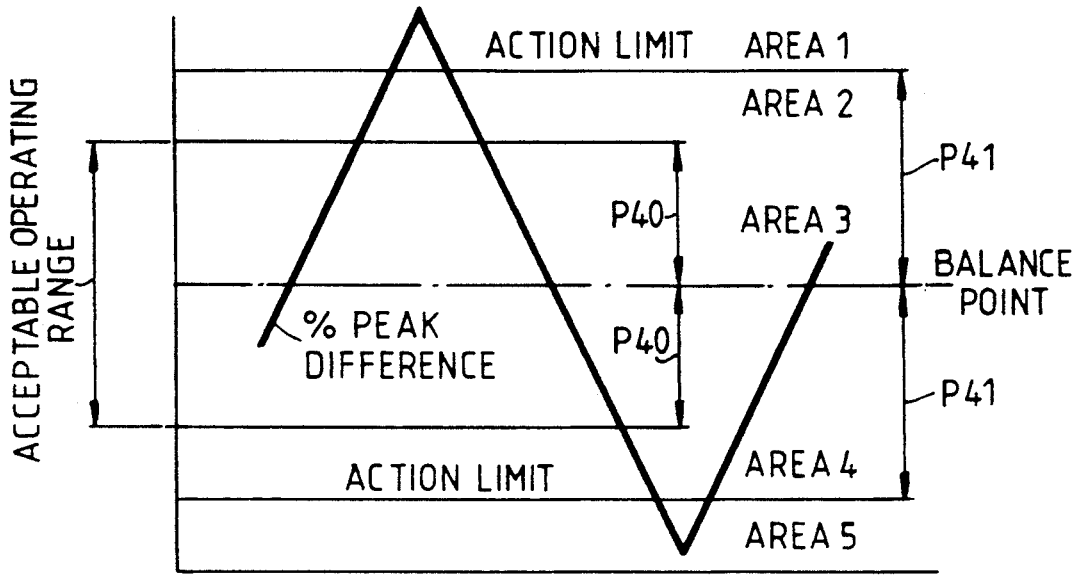
FIG. 3 graphically depicts relationships of upstroke and downstroke peak motor currents that call for supplying air to or venting air from the air-balance control system in practicing the present invention.

FIG. 3 depicts the various operating conditions of air pressure within the air receiver tank that may or may not call for the actions of adding air or venting air. FIG.

Figures 5, 6, 7:
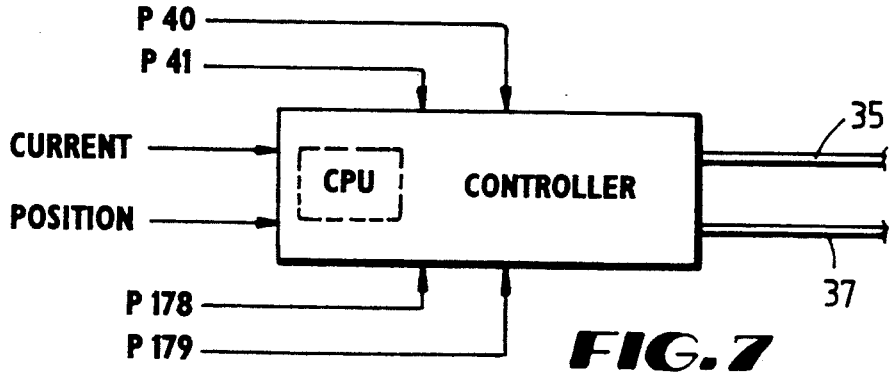
FIG. 5 defines certain timer start actions that may occur at position 1 of FIG. 4.
FIG. 6 defines certain timer start actions that may occur at position 2 of FIG. 4.
FIG. 7 depicts a controller with its associated central processing unit (CPU) of present invention.

3 is divided into areas 1 through 5 and these areas are related to what action is to be taken, if any, as shown in FIGS. 5 and 6. A percent value, identified as $P_{40}$, is entered into the controller (FIG. 7) which establishes an acceptable peak current difference operating range around the balance point. The balance point is the point at which the upstroke peak current equals the downstroke peak current. The value $P_{45}$ is equal to the absolute value of the difference between peak upstroke and downstroke currents, divided by their average, expressed as a percentage. $P_{40}$ is preferably set at 2%, thus the normal or acceptable operating range is ±2%. Another percent value, identified as $P_{41}$, is entered into the controller which establishes the limit of the difference between upstroke peak current and the downstroke peak current, beyond which air will either be added to or released from the cylinder to bring the pumping unit back into the acceptable operating range. The value $P_{41}$ is preferably 5%.

Air is released or added to the air balance cylinder via the electrically operated solenoid valves 34 and 36 which are electrically coupled to the controller. The amount of time the add air solenoid valve 34 stays open is established by a value $P_{178}$ entered into the controller (FIG. 7). Similarly, the amount of time the release air solenoid valve 36 stays open is established by a value $P_{179}$ also entered into the controller. Each of valves 34 and 36 has an associated timer in the controller. Once its associated timer has been actuated (starts to count down to zero), valve 34 or 36 will stay open. Thus, the logic in the controller starts the timer associated with air solenoid valve 34 or 36 based on inputs to the controller (FIG. 7).

Figure 4:
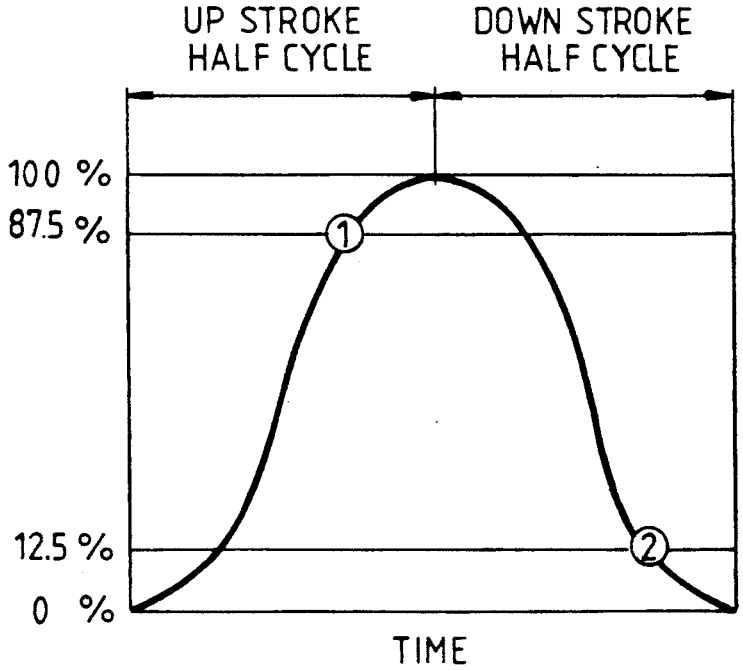
FIG. 4 graphically depicts one complete cycle of the pump action to illustrate certain decision points that are made in practicing the present invention. That is, FIG. 4 relates the position of the pumping unit and when certain timers in the controller logic may be started.

The add air timer will only be started (opening the add air valve or restarted, keeping the add air valve open) at point 1 of FIG. 4; that is, at the point 87.5% of a upstroke. Similarly, the release air timer will only be started (opening the release air valve or restarted, keeping the release air valve open) at point 2, 87.5% of a downstroke.

On the upstroke of the pumping stroke cycle the controller measures the motor current from 12.5% of the travel to 87.5% of the travel from the bottom of the stroke to the top of the stroke. That is, no motor current data is collected during the first and last 12.5% of travel of the stroke in each direction. The peak current value which occurs during this travel is determined and retained. This value is identified as $P_{42}$, or upstroke peak current ("UPC"). Similarly, on the downstroke the controller measures the motor current between 12.5% and 87.5% of the travel from the top of the stroke to the bottom of the stroke. The peak current value which occurs during this travel is determined and retained. This value is identified as $P_{43}$, or downstroke peak current ("DPC"). A percent value identified as $P_{45}$ is calculated by the controller. This value $P_{45}=(P_{42}-P_{43})/((P_{42}+P_{43})/2))\times 100$. The absolute value of $P_{45}$ is compared to $P_{41}$. If $|P_{45}|$ is greater than $P_{41}$ and the sign is positive, (upstroke peak current greater than downstroke peak current), then a determination is made as to what action to take based on the matrices of FIGS. 5 and 6. In FIGS. 5 and 6, the term SAT refers to "start (or restart) add timer," the term SRT refers to "start (or restart) release timer," and NC refers to "no change from previous action." As used herein, the term "activation signal" is understood to mean any of SAT, SRT, or NC.

The controller requires three parameters to determine the action to be taken: (1) the absolute value of $P_{45}$ relative to $P_{40}$ and $P_{41}$ (this relationship determines which area of FIG. 3 the system is operating in); (2) the position of the sucker rod string in the stroke cycle; and (3) the previous action of the controller. Note that FIG. 3 relates the condition of the motor current to the desired operating conditions and FIG. 4 relates the position of the sucker rod string and when add or release timers are to be started. In FIG. 4, the point labeled "1" refers to the point at which the controller determines the action to be taken and at this point the controller can only start or restart the add air valve timer or no change is made from previous action. At point "2", the controller determines the action to be taken and can only start or restart the release air valve timer or no change is made from previous action.

FIG. 5 depicts the action to be taken at point "1" of FIG. 4. If system conditions demonstrate that the system is operating in area 1 of FIG. 3 (upstroke peak current is greater than downstroke peak current by more than 5%) and the previous action was either a start of the add air timer or no change in action, then the controller starts the add air timer. The add air solenoid valve will remain open until this timer times out. Similarly, if the system is operating in area 2(UPC) DPC by more than 2% but by less than 5%) and the previous action was a start of the add air timer, then the controller will restart the add air timer. Otherwise, no change from the previous action is taken.

Similarly, FIG. 6 depicts the action to be taken at point "2" of FIG. 4. If system conditions demonstrate that the system is operating in area 5 of FIG. 3 (downstroke peak current is greater than upstroke peak current by more than 5%) and the previous action was either a start of the release air timer or no change in action, then the controller starts the release air timer. The release air solenoid valve will remain open until this timer times out. Similarly, if the system is operating in area 4 (DPC) UPC by more than 2% but by less that 5%) and the previous action was a start of the release air timer, then the controller will restart the release air timer. Otherwise, no change from the previous action is taken.

The present invention has been described in relation to pumping motor current and sucker rod string position. Another parameter than can be measured directly and related to the torque on pumping unit components is the length of time for each successive upstroke and downstroke. In such a system, the controller need only have the sucker rod position as an input (as well as $P_{40}$, $P_{41}$, $P_{178}$, and $P_{179}$). In this case, $P_{40}$ and $P_{41}$ represent the differences in the length of time for an upstroke and a downstroke expressed as a percentage and may have the same, preferred numerical value as before. In this embodiment, a counter/detector in the controller detects the end of each upstroke and downstroke from the input of the position detector. The end of the upstroke or downstroke starts and stops the counting of an accurate clock or other equivalent means of determining the time duration of each successive half stroke. The controller stores the time duration of each successive half stroke and compares it with the previous half stroke. The controller calculates the value of $P_{45}$ and uses FIGS. 3-6 to determine if the add air clock or the release air clock is to be started, thus opening (or maintaining open) the appropriate add air or release air valve. Those of skill in the art will readily recognize that, in this embodiment, the pumping motor need not be an electrical motor, but any equivalent motive means of driving the pumping unit.

Further, the present invention has been described as using a clock for each of the cylinder air pressure control valves 34 and 36. However, those of skill in the art will recognize that any appropriate means of maintaining valves 34 and 36 in the open position for a predetermined period of time will suffice and would fall within the scope and spirit of the present invention. These and other changes and modifications to the preferred embodiment will fall within the scope and spirit of the invention.

We claim:

1. A method of controlling an air-balance compensation system in a sucker rod pumping unit having an electric motor and a sucker rod string, comprising the steps of:

a. sensing the current to the electric motor and developing a first signal indicative of this current;

b. continuously sensing sucker rod string position and developing a second signal indicative of this position; and c. processing the first signal and the second signal to develop a control signal to control the air-balance compensation system.

2. An air-balance control system for a sucker rod pumping unit that operates in successive upstrokes and downstrokes, the pumping unit having an electric motor, a sucker rod string, and an air-balance compensation system including an air add valve and an air release valve, the control system comprising:

a. a current sensor to sense the electrical current drawn by the electric motor in successive upstrokes and downstrokes and develop a motor current signal indicative of the peak current during each upstroke and downstroke;

b. a position sensor to sense the position of the sucker rod string and develop a position signal indicative of that position;

c. a controller to receive the current signal and the position signal comprising:

(i) a computer to develop a difference signal indicative of the difference between the motor current signals of each successive upstroke and downstroke; and (ii) activator means to generate activation signals to activate a first timer to control the air add valve or a second timer to control the air release valve based upon the position signal, the difference signal, and the immediately preceding activation signal.

3. An air-balance control system for a sucker rod pumping unit having an electric motor, a sucker rod string, and an air-balance compensation system comprising:

a. air control valves in the air-balance compensation system under the control of the air-balance control system;

b. a current sensor to sense the electrical current drawn by the electric motor and develop a first signal indicative of that current;

c. a position sensor to sense the position of the sucker rod string and develop a second signal indicative of that position;

d. a controller to receive the first signal and the second signal and to develop a control signal to control the air-balance compensation system, the controller including timers that dictate the operation of each of the air control valves.

4. The air-balance control system of claim 3 wherein the electrically operated air control valves are solenoid operated air-control valves.

5. An air-balance control system for a sucker rod pumping unit having a pumping motor, a sucker rod string, and an air-balance compensation system comprising:

a. a position sensor to sense the position of the sucker rod string in successive upstrokes and downstrokes and to develop a position signal indicative of that position;

b. a computer to calculate the time duration of each successive upstroke and downstroke and to develop a difference signal indicative of the percent difference in the time duration of each successive upstroke and downstroke; and c. a controller to receive the position signal and the difference signal and to develop a control signal to control the air-balance compensation system.

6. The air-balance control system of claim 5 wherein the air-balance compensation system includes electrically operated air control valves under the control of the air-balance control system.

7. The air-balance control system of claim 6 wherein the electrically operated air control valves are solenoid operated air-control valves.

8. The air-balance control system of claim 6 wherein the controller further includes timers that dictate the operation of each of the electrically operated air control valves.

* * * * *